United States Patent [19]

Nagel et al.

[11] 3,952,496

[45] Apr. 27, 1976

[54] COMPOSITE THREAD

[75] Inventors: Manfred Nagel, Wawern; Rainer Seuss, Konz, both of Germany

[73] Assignee: Akzona Incorporated, Asheville, N.C.

[22] Filed: May 21, 1973

[21] Appl. No.: 362,183

Related U.S. Application Data

[62] Division of Ser. No. 12,220, Feb. 19, 1970, Pat. No. 3,763,640.

[30] Foreign Application Priority Data

Feb. 19, 1969 Germany ..... 1908219

[52] U.S. Cl. ..... 57/144; 57/140 J

[51] Int. Cl.[2] ..... D02G 3/34; D02G 1/02

[58] Field of Search ..... 57/144, 152, 163, 157 TS, 57/160, 140 J, 140 N, 6, 34 HS

[56] References Cited

UNITED STATES PATENTS

| | | | |
|---|---|---|---|
| 3,041,812 | 7/1962 | Marshall | 57/6 |
| 3,132,462 | 5/1964 | Kim et al. | 57/34 HS |
| 3,303,640 | 2/1967 | Rgid et al. | 57/163 |
| 3,309,863 | 3/1967 | Hermes | 57/163 |
| 3,357,171 | 12/1967 | Marshall | 57/160 |
| 3,401,516 | 9/1968 | Chidgey et al. | 57/144 X |
| 3,410,076 | 11/1968 | Dyer | 57/140 J |
| 3,410,077 | 11/1968 | Marzocchi et al. | 57/144 |
| 3,411,287 | 11/1968 | Benson | 57/140 J |
| 3,447,302 | 6/1969 | Field, Jr. | 57/160 X |
| 3,540,204 | 11/1970 | Tanaka et al. | 57/163 |
| 3,568,424 | 3/1971 | Marshall | 57/6 |
| 3,577,873 | 5/1971 | Waters | 57/144 |
| 3,640,064 | 2/1972 | Palm et al. | 57/144 |

*Primary Examiner*—John Petrakes

*Attorney, Agent, or Firm*—Johnston, Keil, Thompson & Shurtleff

[57] ABSTRACT

Process of producing a composite thread in which at least one multifilament thread is run freely and substantially perpendicularly onto a core thread being drawn through a false-twist interval, such that the multifilament thread forms a sheath of at least partially separated filaments wrapped around the core thread, at least one of the core and sheath threads being heat-fixed or heat-set while in a twisted state. The product of the invention is a composite thread exhibiting the properties of natural fibers, especially wool-like properties, with relatively large variations in texture and crimping characteristics. The apparatus of the invention includes, in addition to conventional false-twist means for the core thread, a delivery means to supply at least one additional multifilament thread in a free path substantially perpendicularly onto the core thread in its false-twist interval.

14 Claims, 10 Drawing Figures

COMPOSITE THREAD

This is a division of application Ser. No. 12,220, filed Feb. 19, 1970, now U.S. Pat. No. 3,763,640.

Over a long period of time, it has been recognized that fully synthetic yarns and threads normally have a number of unfavorable properties such as low covering power, low heat-retention and the like. Therefore, many attempts have been made to treat such synthetic yarns or threads so that they will more closely resemble natural fibers such as wool, for example by various texturizing processes. The known texturizing processes include, for example, compression or stuffer box crimping, torque or false-twist crimping, knit-crimping, edge-crimping and air-bulking or jet texturizing methods. In comparison to untexturized threads or yarns, all of these known texturizing processes develop a better handle, a greater covering power and also better heat retention in the yarn or thread product. However, all such artificially texturized synthetic filaments, threads and yarns differ quite distinctly in the feel or handle of the finished product from that of a yarn or textile structure produced from wool or other natural fibers. Moreover, previously texturized synthetic yarns and threads in the form of textile products have a wear resistance which is still substantially inferior to that achieved with natural fibers such as wool.

Although wear resistance or abrasion resistance can be improved by imparting a permanent and durable twist to synthetic thermoplastic threads, the resulting thread and fabrics correspondingly lose most of their softness or bulky handle which is characteristic of natural fibers. Thus, good wear resistance together with a natural handle has not been achieved, even though many variations have been tried in terms of using texturized synthetic threads and/or composite threads. Processes which merely provide a bulky voluminous yarn are not sufficient to yield good wear resistance, whereas processes in which such bulky yarns are again tightly twisted substantially lose the desired handle.

Although various processes are known for producing a composite thread in which some degree of texturizing is also attempted, these prior composite threads do not exhibit satisfactory results. For example, one process is known in which two threads are conducted at different velocities to a thread guide or eyelet at which the threads are brought together and then conducted in common through a false-twist apparatus which includes a heating means for fixing or setting the false twist. In this process, however, the threads are merely twisted around one another so that upon leaving the false-twist spindle, they again adopt a strictly parallel relationship, e.g. to such an extent that they can be separately wound on different spools. In this respect, attention is directed to French Pat. No. 1,251,346. Methods of jet texturizing have also been combined with the production of composite threads, but again without fully satisfactory results. In general, no process is available which permits the production of a fully synthetic thread or even a partially synthetic thread having both the wear resistance and handle of a natural fibrous thread, especially one which would be similar to wool.

One object of the present invention is to provide a composite thread which not only has the handle or texture of wool but also exhibits a considerable improvement in the wearing properties of the final products. Another object of the invention is to provide a novel process for the production of such a composite thread wherein it is possible to utilize the generally known false-twist treatment of a yarn or thread. Still another object of the invention is to provide a process for the production of a composite thread in which a reasonably wide choice of process conditions within given limits permits one to obtain the handle and properties of other natural fibers in addition to the properties of a typical wool thread. Other objects and advantages of the invention will become more apparent upon a detailed consideration of the following specification.

It has now been found, in accordance with the invention, that one can produce a composite thread with properties similar to those of wool threads or other natural fibers, in a process which essentially includes conducting a multifilament core thread through a false twist interval, supplying at least one additional multifilament thread to run freely onto said core thread within the false twist interval in a direction which is approximately perpendicular to the axis of the core thread, thereby forming a sheath composed of at least partially separated filaments wrapped around said core thread, and heat fixing at least one of said core and sheath threads while in a twisted state.

The invention provides a novel composite thread which is essentially characterized by a core thread formed in the false-twisting of at least one multifilament thread and a sheath consisting of at least one additional multifilament thread wrapped around the core thread with at least a partial separation of the sheath into its individual filaments in an irregular pattern along the core thread. It is especially desirable to employ a durably heat-set core thread, but it is also feasible to durably heat-set one or more of the threads in the sheath. In a particularly preferred embodiment of the invention, the false-twisted and durably heat-set core thread is wrapped alternately clockwise and counterclockwise by the at least partially and preferably predominantly separated filaments of the sheath along random portions of the core thread. Enlarged and relatively elongated nodules or slubs can be formed along the random portions of the core thread by a substantially complete overlapping or reversal of the sheath in the alternate clockwise and counterclockwise wrapping of the sheath filaments. The process of the invention offers a number of variations with corresponding changes in the structure of the composite thread, as described more fully hereinafter. Suitable apparatus for the invention is also described in greater detail hereinafter.

The invention can be more fully understood with consideration of the following detailed specification together with the accompanying drawings in which:

FIG. 1 is a schematic illustration of the apparatus required for producing the composite thread of the invention, including several different alternative embodiments;

FIGS. 2*a*, 2*b* and 2*c* provide an enlarged view of the point or location at which a sheath thread is wrapped around a core thread in the process of the invention, three views being required to generally illustrate a fluctuating movement of the filaments of the sheath thread over a short period of time;

Figure 1:
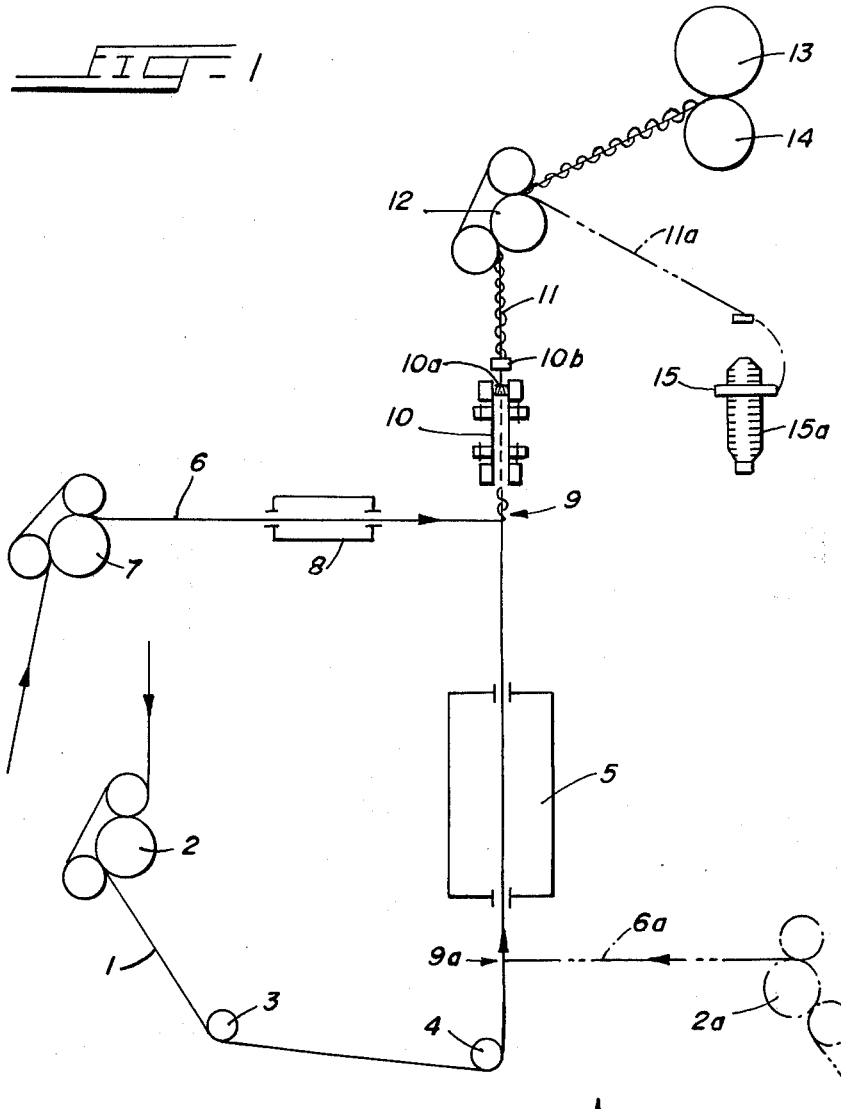

Referring first to FIG. 1, it should be noted that the process of the invention can be carried out with a conventional false-twist device or assembly wherein a multifilament core thread 1 is initially fed by the delivery rolls or mechanism 2 around two deflecting rollers or guides 3 and 4 and then upwardly through a false twist interval provided with a heating device 5 which can be used to heat-set the false twisted thread or threads. The core thread 1 can also consist of two or more multifilament threads by adding additional delivery mechanisms or by joining a number of threads prior to their delivery into the false twist interval. For purposes of the present invention, it is essential to provide at least one additional multifilament thread 6 which is freely run from the delivery mechanism 7, optionally through a second heating device 8, so as to be taken up and wrapped around the core thread 1 at the point or general location 9. As the sheath thread 6 is wrapped around the false twisted core thread 1, both threads are carried upwardly through the false-twist spindle 10 having a conventional twist trapper 10*a* which ordinarily takes the form of a rapidly rotating small wheel or pin around which the traveling composite thread is twisted once or twice in order to release the false twist imparted below the twist trapper. The composite thread 11 emerging from the false twist spindle 10, where it can pass through a suitable thread guide or eyelet 10*b*, is conducted by another delivery mechanism 12 onto a suitable take-up reel or bobbin 13 driven by roller 14. Alternatively, as shown in broken lines, the composite thread 11′ can also be conducted to a so-called ring twister 15 which twists the composite thread as it is taken up on a suitable bobbin 15*a*. In another but leff preferred embodiment of the invention (again shown in broken lines), the sheath thread 6*a* can be conducted by the delivery mechanism 2*a* in order to run freely onto the core thread 1 at a location preceding the heater 5. In order to avoid undue repetition, the supply of additional multifilament sheath threads has been omitted from FIG. 1, but it will be understood that two or more sheath threads 6 can be directed perpendicularly onto the core thread 1 at various points or locations along the false-twist interval.

The foregoing brief description illustrates the overall process of the invention without reference to specific critical or especially preferred conditions which must be observed in carrying out the production of a composite thread in accordance with the invention. At the same time, it should be understood that the present invention does not reside in that portion of the apparatus which constitutes a conventional and well known device or means for imparting a false twist into a relatively rapidly running multifilament thread. These known false-twist devices are normally employed for producing durably crimped thermoplastic threads or yarns in a method sometimes referred to as the torque-crimp process. Many suitable false-twist crimping machines are known in the art, for example as described in considerable detail in the publication of "Woven Stretch and Textured Fabrics", by Berkley L. Hathorne, Interscience Publishers (a division of John Wiley & Sons), New York (1964), Chapter 2 and especially pages 33–59. This publication also discusses the operation of a false-twist machine in connection with U.S. Pat. No. 2,803,109. Thus, each element of a false-twist machine has been carefully described in the prior art for the purpose of introducing a durable crimp into a synthetic thermoplastic thread or yarn. The fundamental element of such machines is the false-twist spindle through which the thread is drawn so as to pass around a wheel or pin which acts as a so-called twister trapper as the spindle is rapidly rotated. The inserted twist extends backwardly along the traveling thread being conducted into the false-twist spindle until it reaches a tensioning means or a suitable delivery mechanism at the feed end of the thread which also stops the twist and prevents it from traveling back to the feed supply, e.g. a bobbin or pirn which constitutes a supply package. In FIG. 1 of the drawings, the roller or guide 3 functions as a twist stopper but can obviously be replaced by other tensioning or delivery means such as a spring-loaded tension gate or a suitable feed roll operated with tension control means.

For purposes of the present invention, the false-twist interval is defined as that portion of the path of the core thread 1 which falls between the lower guide or tensioning means 4 and the false-twist spindle 10. In terms commonly employed in this art, however, the false-twist interval can also be considered as that portion of the core thread 1 between the twist trapper 10*a* and the twist stopper 4. The heater 5 is usually placed at some distance from the false-twist spindle 10 so that the heated thread has an opportunity to cool and become heat-set or heat-fixed by the time it emerges from the twist trapper 10*a*. Many different heating devices have been used in this art, but in general it is preferable to employ a rather elongated heating chamber with the best results being achieved with radiant heat. Again, it should be noted that all such steps which involve the false twisting of the core thread, the manner in which it is delivered to the false-twist spindle and the heat-setting of the core thread conform to conventional practices in this art and permit a wide range of variations in the apparatus used and the conditions under which false-twisting is carried out.

The sheath thread or threads of the invention may also be referred to as enveloping or wrapping threads and are preferably composed of a large number of continuous synthetic thermoplastic filaments, e.g. as commonly produced from fiber-forming polyesters, polyamides, polypropylene and the like. Although the sheath thread can be twisted to some extent, it is preferable to employ an initial thread which has substantially zero twist or only a very slight amount of twist. In any event, the initial supply of the sheath thread should not exhibit a twist which exceeds or goes appreciably beyond a twist factor $\alpha_m$ of approximately 30. The maximum permissable twist factor of the initial sheath thread can be readily determined for any particular yarn size or type of polymer filaments. There must be at least a partial separation of the sheath filaments as they are wrapped around the core thread, so that the twist factor of the initial sheath thread must be sufficiently low to permit the required separation of individual filaments.

The twist factor $\alpha_m$ which identifies the amount of twist in a thread is generally well known in the textile industry and is determined by the formula $$\alpha_m = n \sqrt{(Td/9000)}$$

in which $n$ represents the number of turns per unit length, e.g. per meter, and Td represents the yarn size measured as the denier. This twist factor is employed throughout the present specification with reference to the composite thread as well as the initial threads.

It is quite important for purposes of the present invention to direct the supply of the sheath thread or threads in a direction which is perpendicular or approximately perpendicular to the longitudinal or running axis of the core thread. Most importantly, each sheath thread must run freely onto the core thread, i.e. so that the wrapping or enveloping movement of the sheath thread takes place solely by means of the twisting action of the core thread together with its longitudinal movement through the false-twist interval and not by some externally applied means. Thus, the term "free run-on" with reference to the sheath thread refers to the fact that the run-on point or location 9 along the core thread 1 must not be fixed but must form freely. Also, it will be noted that there is no thread guide or eyelet at the run-on point or location 9, and it is essential for purposes of the invention that both the core thread and the enveloping sheath thread be permitted to act freely in this location.

Figure 2A:
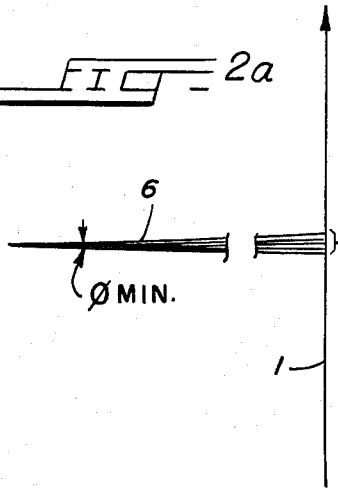
Figure 2B:
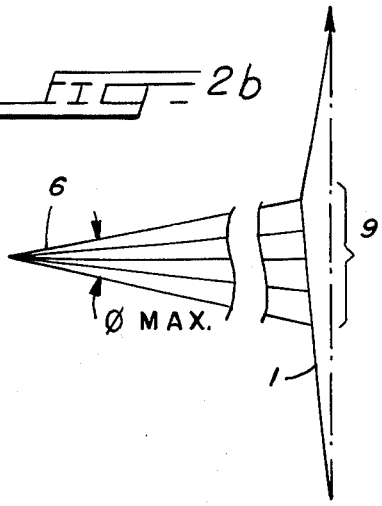
Figure 2C:
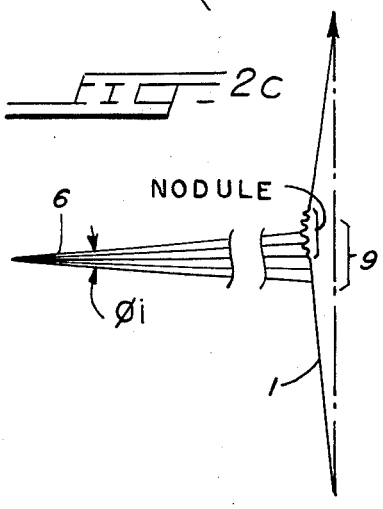
Figure 3:
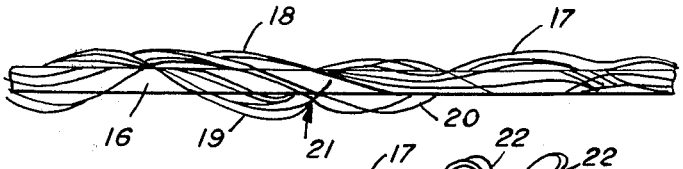
FIGS. 3, 4 and 5 illustrate various embodiments of the composite thread product as produced at different feed rates of the sheath thread.
Figure 4:
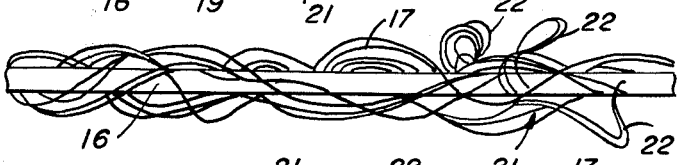
Figure 5:
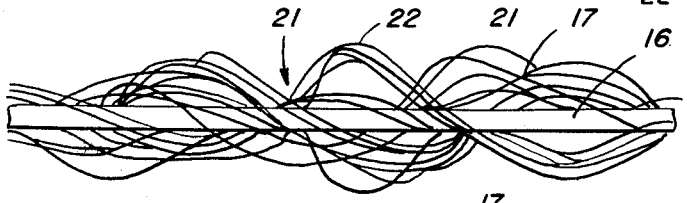

The enveloping or wrapping action of the sheath thread around the core thread can be more readily understood by reference to FIGS. 2*a*, 2*b* and 2*c*. These figures represent an enlargement of the location 9 in FIG. 1, with the understanding that the movement of the individual filaments in the sheath have been illustrated in somewhat stylized form in successive stages of the enveloping movement. Thus, in FIG. 2*a*, the sheath thread 6 is applied perpendicularly to the core thread 1 from a delivery mechanism which can be indicated by the point P. As the sheath thread is first introduced onto the core thread, the individual filaments of the sheat thread may remain relatively close together in an untwisted state. However, the twisting action of the core thread begins to spread the filaments apart along the circumference of the core thread, so that at this stage the angle of spread $\theta$ is at its minimum with all of the filaments being quite close to the perpendicular direction with reference to the core thread. As the individual filaments are spread out along the core thread, the angle $\theta$ reaches a maximum as shown in FIG. 2*b* with the uppermost filament or small group of filaments being placed under relatively greater tension than the filaments which tend to spread apart therebelow. Then, as shown in FIG. 2*c*, there is a strong tendency for the uppermost filament or small group of filaments to reverse their direction of travel along the core thread, i.e. so as to move backwardly along the direction of travel of the core thread. A reverse overlapping or countertwisted group of filaments thus begins to form while the angle $\theta$ again narrows to an intermediate size. At the same time, the lowermost filaments may travel forwardly along the core thread to further reduce the angle $\theta$ until it again reaches a minimum such as in FIG. 2*a*, while also forming a nodule or slub of overlapping and countertwisted filaments. This type of action is repeated again and again with a fluctuating spread or slight angular displacement of the individual filaments of the sheath thread along the axis of the core thread. Each such fluctuation produces a nodule or slub which will tend to vary in both size and location along the core thread, depending upon the velocity at which the threads are brought together, the amount of overfeed of the sheath thread and a number of other factors.

This sequential enveloping and fluctuating movement of the sheath thread has been photographed with a high speed camera in order to carefully view the manner in which nodules or slubs can be produced by the reciprocating or alternating clockwise and counterclockwise application of the sheath filaments. The representation of only three different stages in this action provides only a limited portrayal of the wide variety of results which can be achieved. It should be recognized, however, that the filament or small group of filaments of the sheath which place the greatest tension on the core thread tend to be wrapped tightly thereon with only a limited movement along the longitudinal direction of the core thread. Also, this tension is sufficient to slightly pull the core thread from its normal linear path in the false-twist interval. However, the filaments of the sheath still tend to remain at approximately a right angle to the core thread. Most importantly, the fluctuating movement of the sheath filaments must be permitted to develop freely, and for this reason, any structural element such as the delivery means 7 or a heater 8 as well as any guide means must be positioned at a sufficient distance from the core thread so that it will not interfere with the desired action. In general, such a structural element must be located at a distance of at least about 30 to 100 mm., depending upon the yarn size of the sheath thread being delivered. If the minimum distance of the thread guide or similar structural element is less than 30 mm., then the results achieved according to the invention become obviously poorer and will finally vanish completely as the thread guide approaches closely to the run-on point 9. The maximum distance of this thread guide or structural element most closely situated to the core thread in the linear perpendicular path of the sheath thread is substantially less critical, and such a maximum distance will depend primarily on maintaining reasonable space requirements for the apparatus as well as preventing too heavy a load of the sheath thread being carried over a long distance.

Where more than one sheath thread is supplied to the core thread, i.e. at several points 9, the multiple wrapping points should be situated far enough apart from one another so that there is no interference between the individual wrapping or enveloping action of each sheath thread. Also, when using several enveloping threads, it is preferable to supply them at different delivery rates even though the effect according to the invention can also be achieved when they have the same delivery rate with quite satisfactory results which may be advisable in special cases.

It has been found that the most favorable effect is achieved if the sheath thread or threads are supplied to the core thread within an over-feed rate of 10 to 120% and preferably 15 to 100%. The amount of over-feed of the sheath thread can be easily regulated with known delivery means, and if desired, this rate of delivery may also be fluctuated in a predetermined pattern. A very irregular effect, which is quite desirable under some circumstances, can be achieved by preferably using only one sheath thread which is supplied in the absence of any positive delivery, e.g. directly from a delivery spool, so that the sheath thread is drawn off from its supply source solely by the twisting of the core thread in the false-twist interval. In other words, the core thread itself provides the means of drawing off the incoming sheath thread from a delivery spool.

It is generally preferable to heat-fix or provide a durably heat-set crimp in the core thread by conventional use of the heating device 5. On the other hand, it is also possible to heat the sheath thread or threads by means of the heating device 8, which is likewise preferably an elongated radiant heater. This provides a certain fixation or setting of the sheath thread as it meets and envelops the core thread, so that the heater 8 is preferably placed as close as possible to the point or location 9 without interfering with the enveloping action of the sheath thread or filaments. Of course, where the sheath thread 6*a* is supplied to the core thread before the heater 5, both the sheath and core threads will undergo a heat-fixing or setting in the false-twist interval. Moreover, it is possible to heat only the sheath thread while permitting the core thread to pass through the false twist interval in the cold state. In this case, there is no texturization or durable crimping of the core thread and the finished composite thread has very little or no elastic stretch.

Many different special effects can be achieved in finished textile fabrics by using the composite threads of the invention produced under a variety of different conditions. For example, the exact structure of the composite thread is affected by such conditions as the supply speed of the sheath thread, the draw-off speed of the delivery device arranged after the false-twist spindle, the turning speed of the false-twist spindle and the supply speed of the core thread. Each of these conditions can be varied individually or several or all of such conditions can be applied together. Also, if the sheath thread is pretwisted to a twist factor of up to approximately 30, this can also have a considerable influence on the finished composite thread.

It has been found that the bulkiness and feel or handle of the composite thread can be varied over a wide range by:

a. the above-mentioned conditions under which the various threads are supplied and conducted through the false-twist interval as well as being drawn off and collected after the false-twist spindle;
b. the choice of the total yarn size or denier of the composite thread;
c. the selection of different individual yarn sizes for the core and sheath threads so that one is larger or smaller than the other; and
d. Imparting an initial twist to the sheath thread or threads up to a twist factor $\alpha_m$ of about 30, whereby the feel or handle of the composite thread becomes increasingly harder with a larger twist factor.

Other properties such as a pilling tendency can also be varied by this initial twisting of the sheath thread or threads.

In general, it has been found that the properties and appearance of a finished textile fabric composed of the composite threads of the invention fundamentally depends upon the structure of the core thread while the feel or handle depends primarily upon the sheath thread and the manner in which it envelops the core thread. By suitable variations of the process conditions of the invention while observing essential limitations, it is possible to produce composite threads which exhibit virtually any handle or feel peculiar to wool as well as the handle or feel of almost any natural fiber. In particular, it is possible to achieve a very wide range of wear resistance in the finished product. Moreover, a very high wear resistance can be achieved without losing the desirable natural softness or wool-like texture of the composite thread and fabrics produced therefrom.

The effects achieved with the process of the invention were quite surprising. Since the sheath or enveloping thread being supplied to the core thread also participates in the false-twist imparted to the core thread in the false-twist interval, it was to be expected that the individual core and sheath threads forming the composite thread would again be arranged parallel to one another after leaving the false-twist spindle. It is of course well known that the false-twist process itself is designed to impart a temporary twist in the false-twist interval which then dissolves or disappears after the thread runs through the false-twist spindle and emerges from the twist trapper. Thus, without any heat-setting of the core thread, there would be very little or no twist in the core thread after leaving the false-twist interval. Since the sheath thread is not tightly twisted and need not even be heated before being supplied to the false-twist interval, it was particularly surprising that it did not simply lose its twist or envelopment around the core thread after emerging from the false-twist interval. In fact, the sheath thread does wrap itself about the core thread in a very desirable manner, and the various effects which can be achieved are not lost after the composite thread emerges from the false-twist spindle.

When producing a composite thread according to the process of the invention, the initial product emerging from the false twist interval has a substantially permanent structure in which there is a definite winding of the sheath thread or threads around the core thread, held in place at irregular intervals by a loosely knotted or tangled sheath filament or individual bundle of filaments accompanied by at least a partial reversal of the twist direction of the sheath filaments. Variations of this structure are described below with reference to different operating conditions related to the false-twist interval.

As the composite thread is delivered from the false-twist spindle to a take-up spool or bobbin, it is generally wound with a relaxation of about 3 to 30%, i.e. under a sufficient reduction in tension to permit crimp contraction with a winding onto the take-up spool in the normally relaxed state of the thread. It is preferable to impart a second heat fixing step as is often performed in a known manner upon durably heat set false-twist yarns, i.e. a reheat setting or partial resetting of the thread emerging from the false-twist spindle. Such post-treatment of false-twist yarns tends to improve their uniformity, increase softness and/or eliminate shrinkage in the finished thread, and offers similar advantages when applied to the composite thread of the present invention. Again, conditions such as tension, the amount of heat applied and the like conform to conventional procedures used in the known false-twist process and do not constitute an essential feature of the present invention.

Finally, the composite thread of the invention is preferably given a final twist as it is collected on a take-up spool or bobbin, e.g. by means of a conventional ring twister as illustrated in FIG. 1. This final twist preferably imparts a twist factor $\alpha_m$ of about 38 to 100, especially about 45 to 90. It will be understood, of course, that this final twist is superimposed onto the composite thread after it emerges from the false-twist interval and with or without a subsequent reheat setting of the initially formed composite structure.

The process of the invention is particularly advantageous as applied to the use of continuous multifilament threads or yarns composed of synthetic fiber-forming linear thermoplastic polymers, both in the core and the sheath threads. Although a wide range of yarn size can be employed for both the core and sheath threads, especially good results have been achieved when working within a total yarn size of about 50 to 200 dtex (i.e. 5 to 20 tex or about 45 to 180 denier) and an individual filament size of about 3 to 6 dtex, preferably 3.3 to 5.5 dtex. With the initial core and sheath threads each maintained within these limits, the resulting composite thread can exhibit approximately the following yarn size values, depending upon the type of fabric to be made therefrom:

| Fabric | Needles/inch | dtex |
|---|---|---|
| Circular Knitted | 16 to 20 | 250 to 1500 |
| Flat Knitted | 8 to 14 | 250 to 1500 |
| "Cotton" | 6 to 18 | 300 to 1500 |

The higher yarn sizes can be achieved by plying two or more of the threads having the preferred yarn size values set forth above with reference to the individual core and sheath threads. Thus, it is possible to obtain typical fabrics by conventional knitting or weaving operations, but within a wide range of texture and wear-resistance which closely approximates natural fibers and particularly wool.

The following example will serve to illustrate one embodiment of the invention, representing only one of many possible variations.

EXAMPLE

Using the apparatus shown in FIG. 1 with heater 5 in operation to provide a durably heat-set crimping of the core thread and with one non-heated sheath thread introduced between heater 5 and false-twist spindle 10 with substantially zero twist, a composite yarn is formed using identical core and sheath threads composed of continuous polyethylene terephthalate delustered filaments having a circular cross-section, each thread having a yarn size of 76 dtex and composed of 24 identical individual filaments.

The core thread is delivered to the false-twist interval at a rate of 100 meters/minute where it is maintained under tension while a false-twist is imparted by rotating the false-twist spindle at a rate of 5000 revolutions/-second.

The sheath thread is positively delivered perpendicularly to the core thread as shown in FIG. 1 in a free path of about 500 mm. so as to run freely onto the core thread at an overfeed rate of about 50%. In this production of the composite thread, two such yarns or threads are plied and given an S-twist of 500 turns per meter.

The production of a fabric is then achieved on a flat-knitting machine with 12 needles per inch in a so-called half-circular weave by running in the two-ply composite thread with two times a yarn size of 375 dtex. The resulting fabric has a remarkable wool-like appearance and handle with substantially improved properties of wear-resistance in comparison to known products produced from synthetic yarns of a similar texture.

A careful examination of the thread employed in the production of the fabric in this example revealed the essential characteristics of the individual composite threads, i.e. a reversal of the direction of twist of the sheath thread at the point at which a nodule or tangle is formed at irregular locations along the length of the core thread. In this instance, the individual knots or tangles are relatively short in length but correspondingly frequent in random occurrence so as to provide reentrant loops of individual filaments of the sheath at individual points of twist reversal. These loops are relatively open and loose in the formation of a tangled node and appear to be caused primarily by a single filament or very few filaments of the sheath reversing the normal direction of twist as the sheath is taken up by the core thread. This corresponds to the wrapping action of the sheath in the false-twist interval where there is a relatively large resolution of the sheath thread into its individual filaments, e.g. as indicated in FIG. 2*b*.

Figure 6:
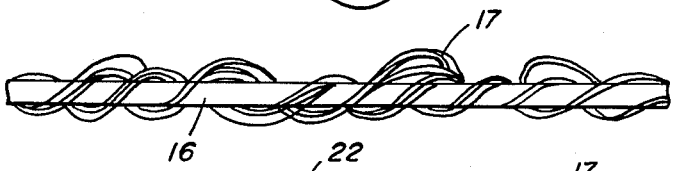
FIGS. 6 and 7 illustrate two different forms of a final composite thread product initially produced at different feed rates but then given a permanent twist of the same amount in each case.
Figure 7:
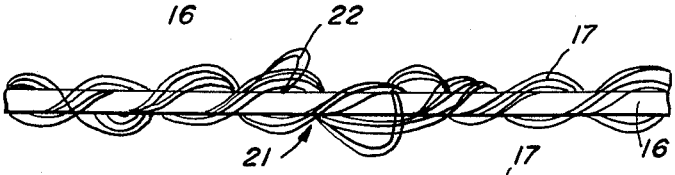

Variations in the structure of the composite thread as produced in accordance with the invention can be further illustrated as shown in FIGS. 3–7, based upon differences in the amount of overfeed of the sheath thread (FIGS. 3–5) and the introduction of a final twist (FIGS. 6–7). In each of the illustrated examples of composite thread structure, the drawing has been simplified to the extent that the core thread 16 is shown as a relatively straight length of a false-twisted and durably heat-set yarn although it will be understood that the core thread itself tends to be curled or contracted to some extent over any significant length due to the application of the sheath tread as well as its durably set false twist.

In FIGS. 3–7, the sheath thread 17 composed of the individual filaments such as 18, 19 and 20 being at least partially separated from one another so as to envelop the core thread 16 and to obscure its image. Especially at higher overfeed rates, which increase from 20 to 50 to 100% in FIGS. 3, 4 and 5, respectively, the composite thread prior to a final twist yields an extremely filmy image with a very irregular distribution of the individual enveloping filaments around the core thread. This is particularly true when using an initially untwisted sheath thread, but even with an initial twist factor $\alpha_m$ of up to about 30, the sheath thread tends to present the same open bulky image unless extremely low overfeed rates are employed. Thus, in all instances, the composite thread emerging from the false-twist spindle is predominately resolved into its individual filaments over the length of the core thread or at least between more tightly enclosed sections which arise from very low feed rates and/or points of entanglement.

Knots or nodes 21 develop at irregular points or places along the core thread 16 as individual filaments or small bundles of filaments of the sheath thread are reversed in their direction of twist, i.e. from clockwise to counterclockwise so that at least some filaments have an S-twist while others have a Z-twist. In some instances, the entire sheath may undergo a complete reversal in this direction of twist over an elongated length of the core thread so as to yield a correspondingly long nodule or slub. In other instances, only a very short knotted or entangled nodule forms, often with the formation of reentrant loops, curls or whorls 22 projecting radially outwardly from the longitudinal axis of the composite thread. As the rate of overfeed increases, these radially projecting loops 22 become more numerous and the sheath achieves a much looser and more irregular appearance.

In FIGS. 6 and 7, the composite yarn produced with an overfeed of the zero twist sheath thread of 50 and 100%, respectively, has been given a final twist to achieve a twist factor $\alpha_m$ of 65, thereby more firmly tightening or closing the sheath filaments 17 around the core thread 17 but at the same time retaining a relatively high degree of bulkiness or texturization resulting especially from the knots 21 and the loops 22 produced thereby. Moreover, the sheath thread is still relatively loose and resolved into individual filaments even after this final twist, particularly when the composite thread is relaxed.

Figure 8:
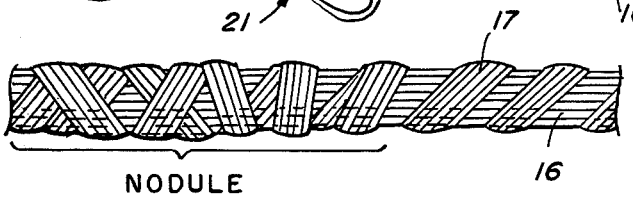
FIG. 8 illustrates still another embodiment of the final twisted composite thread exhibiting a relatively long nodule or slub while employing a core thread and sheath of contrasting color.

Very distinctive results can be achieved as shown in FIG. 8 wherein a relatively long nodule has been formed by a double winding with the sheath and core threads being of a contrasting color. Many such variations can be achieved in order to obtain special effect threads, not only with differences in color but also with the use of multiple sheath threads and with differences in yarn size and number of filaments. Likewise, two or more core threads can be used, including a mixing in of yarns formed of natural fibers.

In addition to variations of the overfeed rate of the sheath thread and the amount of final twist imparted to the composite yarn, there are a number of other conditions which affect the structure of the finished product.

Referring again to FIGS. 2*a*, 2*b* and 2*c*, the initial and preferably untwisted sheath thread which is directed perpendicularly onto the core thread splits open or spreads apart with an ever changing width of separation closely before the run-on point or location 9, i.e. with at least a partial resolution into individual filaments or filament bundles. Observation will show that this run-on point does not stay in one fixed place but executes a constant up and down movement with reference to the vertically running core thread. During this fluctuating movement and at very irregular intervals, the last or lowermost incoming filament or small group of filaments moves up the core thread and in a certain sense overlaps the previously formed windings and, in so doing, again rewinds them. It is this irregular interference in the fluctuating run-on pattern that causes knots or nodules to form at irregular points along the core thread. This phenomenon is especially apparent when the sheath thread is freely supplied and taken up solely by the rotary action of the core thread, i.e. without any positive feed or delivery means, and particularly if the sheath thread is wrapped on the core thread before the heating zone 5. When this effect is pronounced, there results a typical knop yarn having nodules or slubs of different lengths formed at very irregular intervals by the enveloping sheath thread. In the lengths of the composite thread, one can clearly recognize alternating twist directions in the sheath, e.g. a Z-twist occurring before a following S-twist. Furthermore, the composite thread or yarn has a slight crimp stretch capable of imparting a certain amount of elasticity to fabrics produced therefrom.

At an overfeed rate below about 30%, it will generally be observed that the core thread is deflected in the direction of the incoming sheath thread to a greater extent than at higher feed rates where the core thread has a more normally linear path. Nevertheless, the sheath thread tends to remain at a right angle to the core thread under all conditions with a smaller or greater spreading of the sheath filaments as they arrive at the core thread as well as a wandering of the run-on point up and down the core thread. However, with a decreasing overfeed rate, the extent of knotting caused by an overwinding of a previously wound layer of individual filaments will diminish.

If the sheath thread is introduced with a small amount of pretwist, this direction of twisting predominates. Where the core thread enters the treatment interval with a pretwist, then this turning direction of the core thread predominates. However, wide variations in the amount and direction of twist are possible, and the composite thread is most aptly characterized as one in which a core thread resembling a multifilament false-twisted thread is enveloped by at least one sheath thread separated partially and usually predominately into its individual filaments, the wrapping of the sheath thread about the core thread occurring with a clockwise and counterclockwise turning about the core thread alternating with loose knots or nodules lying in between, all in an irregular sequence.

Individual loops can be observed in the enveloping thread or threads, and there can also be a slight crimping or curling. With a free supply or delivery of the sheath thread, i.e. in the absence of a positive delivery onto the core thread, there is a stronger tendency to reduce the bulkiness and crimp-contraction properties of the composite thread while increasing the number of nodules or slubs which may vary in a highly irregular pattern between approximately 5 and 50 mm. in length, with similar lengths between adjacent nodules. Even with this large fluctuation of nodule length and intermediate separation therebetween, a careful examination of a rather long length of the composite thread has shown that there is actually a relatively constant frequency in terms of nodule length, their distance apart and the number of nodules per unit length. At the same time, the composite thread emerging from the false-twist interval has a slight crimp contraction. Between the nodules or slubs, which as a rule are formed of two layers of the enveloping thread, there is visibly apparent the alternating clockwise and counterclockwise rotation or turning of the sheath thread about the core thread, i.e. before any final twist is imparted to the composite thread. A twist of the core thread tends to cause its direction of rotation to predominate, and at least a slight twist improves its resistance to shifting in the composite structure, in which case however the twist factor can reside in or near the lower limit of the final twist range indicated above.

Variations in the apparatus can also be employed as means of affecting the final structure of the composite thread. However, it should be noted that the running direction of the core thread has practically no significance and need not have the vertical position shown in FIG. 1. Also, it can be drawn upwardly or downwardly as in any conventional false-twist machinery. The critical factor is the approximately perpendicular path of the sheath thread or threads in relation to the core thread while avoiding any interference with the fan-shaped or fluctuating pattern of each sheath thread as it runs freely onto the core thread. Where a plurality of delivery means are required, the sheath threads can be easily guided over suitable thread guides or rollers from various points of delivery, provided that the last thread guide in the direction of delivery is not positioned too close to the path of the core thread.

In some cases, it has been found to be advantageous to pass the sheath thread through the heating zone 8 between the delivery means 7 and the run-on location 9. The heating means such as a radiant heater must not be placed so close to the core thread that it would hamper or interfere with the incoming sheath thread with its free back-and-forth movement along the axis of the core thread. With heater 8 in operation, a certain fixation of the sheath thread is also achieved, e.g. so that the formed knots, nodules or slubs as well as the alternating direction of twist are more durably heat-set in place.

An inelastic or substantially inelastic composite thread results if the first heating means 5 remains out of operation and only the incoming sheath thread or threads are heated just before running freely onto the core thread. In this case, however, a second heat fixing step is of special importance because the heating of the sheath thread or threads before the run-on point does not generally assure a permanent fixing of the deformation acquired at or after the run-on point. For this reason, the further heating and setting of the composite thread is expedient under these conditions.

In using the heater 8, it is preferable to supply the sheath thread with positive delivery, using conventional adjustable drive means for the delivery rolls or feed device. Likewise such control of a positive delivery rate permits special effects by varying the delivery rate at regular or irregular and longer and shorter intervals in a predetermined pattern. In this manner, one can readily achieve a carefully controlled but even more irregular knotting, looping and twist reversing of the filaments in the sheath thread as it is applied.

The sheath thread is preferably applied to a heat-fixed and durably crimped core thread as produced in the false-twist interval. This naturally requires a thermoplastic core thread. On the other hand, the sheath thread need not be subjected to heat-fixation or heat-setting so that relatively non-thermoplastic filaments can be employed in the sheath in place of or in admixture with the preferred thermoplastic filaments.

It will be apparent that the process of the invention offers an extremely wide variation in the type of composite thread being produced by means of the numerous conditions or limitations capable of being changed without departing from the relatively few and essential requirements of the process. Thus, an extraordinary range of texturizing effects can be achieved so as to imitate not only wool but also other natural fibers within their own relatively wide ranges of texture, handle, wear-resistance and the like. In this respect, the main process variables of the invention can be summarized as follows:

a. choice of the run-on locations of the sheath thread or threads before or after the heating zone 5;
b. variation of the method of supplying the sheath thread, i.e. with or without a positive delivery;
c. variation of the rate of overfeed within the specified limits;
d. variation of the rate of twist applied to the core thread in the false-twist interval by attuning the draw-off speed of the delivery means 12 after the false-twist interval and the speed of rotation of the false-twist spindle 10 (generally within conventional false-twist rates used in producing a durably crimped thread by the known false-twist process);
e. choice of applying one or more heating zones in the heat-setting and reheat-setting of the individual or combined core and sheath threads;
f. the amount of final twist imparted to the composite thread;
g. variation in the amount of relaxation or tension applied to the composite thread as it is drawn from the false-twist spindle onto a take-up spool, with or without a final twist;
h. choice of appropriate yarn sizes, number of filaments and number of threads, including an initial presence or absence of twist within indicated limits for the supply of sheath thread; and
i. selection of the most appropriate thermoplastic filaments including variations in color as well as composition.

When achieving maximum texturization or softness in handle with the process of the invention, those measures are adopted which tend to provide an extremely irregular, loose and full or voluminous structure, e.g. relatively high overfeed of the sheath thread accompanied by relatively low pretwist and final twist, preferably with a false-twisted and durably heat-set core thread. Such texturization cannot be compared with previously known texturized yarns such as those obtained in so-called looped yarns as produced by jet texturizing of either individual or composite threads or yarns. Even with maximum texturization, the composite threads according to the present invention exhibit a substantially improved wear-resistance which can be even further enhanced by means of more tightly winding or wrapping the sheath thread, for example by avoiding its positive delivery and/or by imparting an additional pretwist to the initial sheath thread and/or a predetermined final twist to the composite thread. Furthermore, this increased wear-resistance is accomplished with a proportionately smaller loss of softness or wool-like handle than is possible with known texturized threads or yarns.

Although the results of the invention can be achieved through a specific combination of otherwise conventional elements of apparatus, it is essential to arrange the apparatus and conduct the process under certain essential conditions, most important of which is the perpendicular supply of the sheath thread with a free or non-supported meeting and run-on of the sheath thread around the core thread. This free run-on must be accompanied by at least a partial separation of the individual filaments of the sheath thread, and at least one of the core and sheath threads, preferably the former should be heat fixed while in its twisted state.

The term "overfeed rate" has been employed throughout this specification with reference to the supply of the sheath thread to mean that rate, expressed as a percentage, of the feed rate at which the sheath thread would otherwise be tightly wrapped around the false-twisted core thread. Even with a free delivery of the sheath thread, i.e. without any positive delivery, at least some of the separated filaments of the sheath thread tend to be loosely wrapped around the core thread, i.e. sufficient to form the desired tangles, loops and nodules.

The invention is hereby claimed as follows:

1. A composite thread comprising at least one false-twisted multifilament core thread and a sheath consisting of at least one additional multifilament thread wrapped around the core thread with at least a partial separation and spreading out of the sheath thread into its individual filaments longitudinally of the core thread in an irregular and fluctuating enveloping pattern of the individual filaments along the core thread, said sheath exhibiting along random portions of the core thread an enlarged nodule characterized by a reverse overlapping application of an individual filament or group of filaments wrapped forwardly and backwardly over the nodule longitudinally of the core thread.

2. A composite thread as claimed in claim 1 wherein at least one of said core and sheath threads consists essentially of a linear fiber-forming thermoplastic polymer which is durably heat-set in the finished product.

3. A composite thread as claimed in claim 1 wherein said nodules have an individual length between about 5 and 50 mm. and are separated from each other along the core thread by a distance of about 20 to 150 mm., with said length and distance fluctuating in a random pattern.

4. A composite thread as claimed in claim 1 wherein the sheath loosely envelops the core thread and exhibits a large number of irregularly spaced projecting knotted loops developed by said wrapping forwardly and backwardly over each nodule along random portions of said core thread.

5. A composite thread as claimed in claim 4 wherein the individual filaments of said sheath loosely enveloping the core thread between said knotted loops are predominately separated from one another.

6. A composite thread as claimed in claim 1 wherein the individual filaments of said sheath are predominately separated from one another.

7. A composite thread as claimed in claim 1 wherein said core thread consists of a plurality of multifilament threads.

8. A composite thread as claimed in claim 1 wherein at least two threads in the composite structure have a contrasting coloration.

9. A composite thread as claimed in claim 1 wherein said sheath of at least one additional multifilament thread is independently twisted about its own longitudinal axis with a twist factor $\alpha_m$ of not more than approximately 30.

10. A composite thread as claimed in claim 1 having a superimposed twist about its longitudinal axis with a twist factor $\alpha_m$ of about 38 to 100.

11. A composite thread comprising at least one twisted multifilament core thread and a sheath consisting of at least one additional multifilament thread wrapped around the core thread with at least a partial separation and spreading out of the sheath thread into its individual filaments longitudinally of the core thread in an irregular and fluctuating enveloping pattern of the individual filaments along the core thread, said sheath exhibiting along random portions of the core thread an enlarged nodule characterized by a reverse overlapping application of an individual filament or group of filaments wrapped forwardly and backwardly over the nodule longitudinally of the core thread.

12. A composite thread as claimed in claim 11 wherein at least one of said core and sheath threads consists essentially of a linear fiber-forming thermoplastic polymer.

13. A composite thread as claimed in claim 12 wherein at least one of said core and sheath threads is durably heat-set.

14. A composite thread as claimed in claim 11 wherein the sheath loosely envelops the core thread and exhibits a large number of irregularly spaced projecting knotted loops developed by said wrapping forwardly and backwardly over each nodule along random portions of said core thread.

* * * * *